US006079891A

United States Patent [19]

Berthelot

[11] Patent Number: 6,079,891

[45] Date of Patent: Jun. 27, 2000

[54] PRINTER DEVICE FOR PRINTING A STRIP MEDIUM

[75] Inventor: Francis Berthelot, Gif sur Yvette, France

[73] Assignee: Axiohm, Montrouge, France

[21] Appl. No.: 09/117,953

[22] Filed: Aug. 12, 1998

Related U.S. Application Data

[63] Continuation of application No. PCT/FR97/01790, Nov. 12, 1996, abandoned.

[51] Int. Cl.[7] ..... B41J 29/13

[52] U.S. Cl. ..... 400/690.4; 400/691; 400/693; 400/120.16; 400/175; 347/222

[58] Field of Search ..... 400/175, 690.4, 400/691, 692, 693, 693.1, 694, 208, 120.16; 347/222

[56] References Cited

U.S. PATENT DOCUMENTS

| | | | |
|---|---|---|---|
| 4,669,896 | 6/1987 | Yokota et al. . | |
| 4,947,185 | 8/1990 | Mitsushima et al. . | |
| 5,129,750 | 7/1992 | Otsuki | 400/690.4 |
| 5,137,385 | 8/1992 | Kamimura et al. . | |
| 5,424,760 | 6/1995 | Wirth et al. . | |

OTHER PUBLICATIONS

Patent Abstracts of Japan vol. 012, No. 257 (M–719), 20 juillet 1988 & JP 63 041159 A (Fuji Xerox Co Ltd), 22 février 1988.

Patent Abstracts of Japan vol. 011, No. 090 (M–573), 10 mars 1987 & JP 61 242863 A (Matsushita Electric Ind Co Ltd), Oct. 29, 1986.

*Primary Examiner*—John S. Hilten
*Assistant Examiner*—Minh H. Chau
*Attorney, Agent, or Firm*—Salzman & Levy

[57] ABSTRACT

A printer device for printing on a strip medium, the device comprising a body (1), a carriage (5) movable in translation along a guide (2) secured to the body (1) and carrying a pivoting print head (7), and resilient means (9) disposed between the carriage (5) and the print head (7), a cover carrying a platen and pivotally connected to the body (1) to pivot between an open position and a closed position in which the print head (7) is held pressed against the platen by the resilient means (9), a locking member carried by the body (1) in retractable manner between a first position in which it co-operates with an abutment secured to the cover and a second position in which it escapes from the abutment, the locking member (17) being secured to a lever (19) hinged to the body (1), the lever (19) having an end that co-operates with the print head in such a manner that during the movement of the locking member (17) between its first and second positions, the end of the lever (19) causes the print head (7) to pivot against the effect of the resilient means (9).

11 Claims, 3 Drawing Sheets

PRINTER DEVICE FOR PRINTING A STRIP MEDIUM

This application is a continuation application of international application, Ser. No. PCT/FR97/01790, filed Nov. 12, 1996, now abandoned.

FIELD OF THE INVENTION

The present invention relates to printer devices having movable print heads and, more particularly, to a printer device having a reciprocal carriage and rectilinear guide.

BACKGROUND OF THE INVENTION

Printer devices of the present invention include a print head, e.g. an ink jet, impact, or thermal print head, pivotally connected to a carriage that moves back and forth across the strip to be printed, along a rectilinear guide secured to a body. The print head is held pressed against a platen by a spring disposed between the carriage and the head, said platen facing the head and being secured to the body. After a line has been printed, the strip, e.g. a strip of paper in the form of a roll that is paid out as printing takes place, is itself displaced perpendicularly to the guide between the print head and the platen by wheels pivotally mounted on the body. When the roll of strip material contained in the device has been used up, it is necessary to install another and to ready the device by inserting the end of the strip inbetween the wheels and between the platen and the print head. In such a device, putting the strip into place in this way can be difficult, and wrong insertion leads to the strip jamming.

To remedy those drawbacks, document WO 96/05062 discloses a printer device comprising a body on which a cover carrying the platen and the wheels is mounted to pivot between a closed position in which the head bears against the platen, and an open position enabling a blank strip to be put into place. After the cover has been opened, it is possible to insert a new roll of strip material, and then the cover is closed while the free end of the strip is held manually so as to be engaged between the platen and the head once the cover is in its closed position.

Such a device makes it easier to install the strip, however while the cover is being moved between its two positions, bumping and rubbing take place between the platen and the print head which is urged into an inclined position by the spring. Such repeated bumping and friction can lead to the print head being damaged or can give rise to slack between the various elements of the device, thus leading to printing of lower quality.

SUMMARY OF THE INVENTION

The invention provides a printer device for printing on a strip medium, the device comprising a body, a carriage movable in translation along a guide secured to the body and carrying a pivoting print head, and resilient means disposed between the carriage and the print head, a cover carrying a platen and pivotally connected to the body to pivot between an open position and a closed position in which the print head is held pressed against the platen by the resilient means, a locking member carried by the body in retractable manner between a first position in which it co-operates with an abutment secured to the cover and a second position in which it escapes from said abutment, the printer device being characterized in that the locking member is secured to a lever hinged to the body, said lever having an end that co-operates with the print head in such a manner that during the movement of the locking member between its first and second positions, the end of the lever causes the print head to pivot against the effect of the resilient means.

In this way, pivoting of the print head as caused by the end of the lever keeps the head away from the path of the platen during movement of the cover between its two positions. The head no longer strikes the platen.

Advantageously, the end of the lever is of a width that corresponds to the length of the displacement of the carriage.

In this way, the end of the lever can co-operate with the head whatever the position of the carriage along the guide.

In a particular embodiment, the locking member includes a camming surface for moving it between its two positions, the camming surface co-operating with the abutment by pressing thereagainst while the cover is pivoting close to its closed position.

In this way, the head is pivoted automatically when the cover is at the end of its closure stroke or at the beginning of its opening stroke.

A pushbutton may be carried by the cover over the camming surface when the cover is in its closed position, action on the pushbutton causing the locking member to be move from its first position towards its second position by sliding on the camming surface.

In a variant embodiment, a pushbutton may be located on the body, operating the pushbutton causing the locking member to move from its first position towards its second position by acting on a drive portion of said member, other than the actuating surface.

Advantageously, in these embodiments, resilient return means are disposed between the body and the locking member to return the locking member to its first position.

Other characteristics and advantages of the invention appear from the following description of an embodiment.

DRAWINGS

Reference is made to the accompanying drawings, in which.

DETAILED DESCRIPTION OF THE PREFERRED EMBODIMENT

Figure 1:
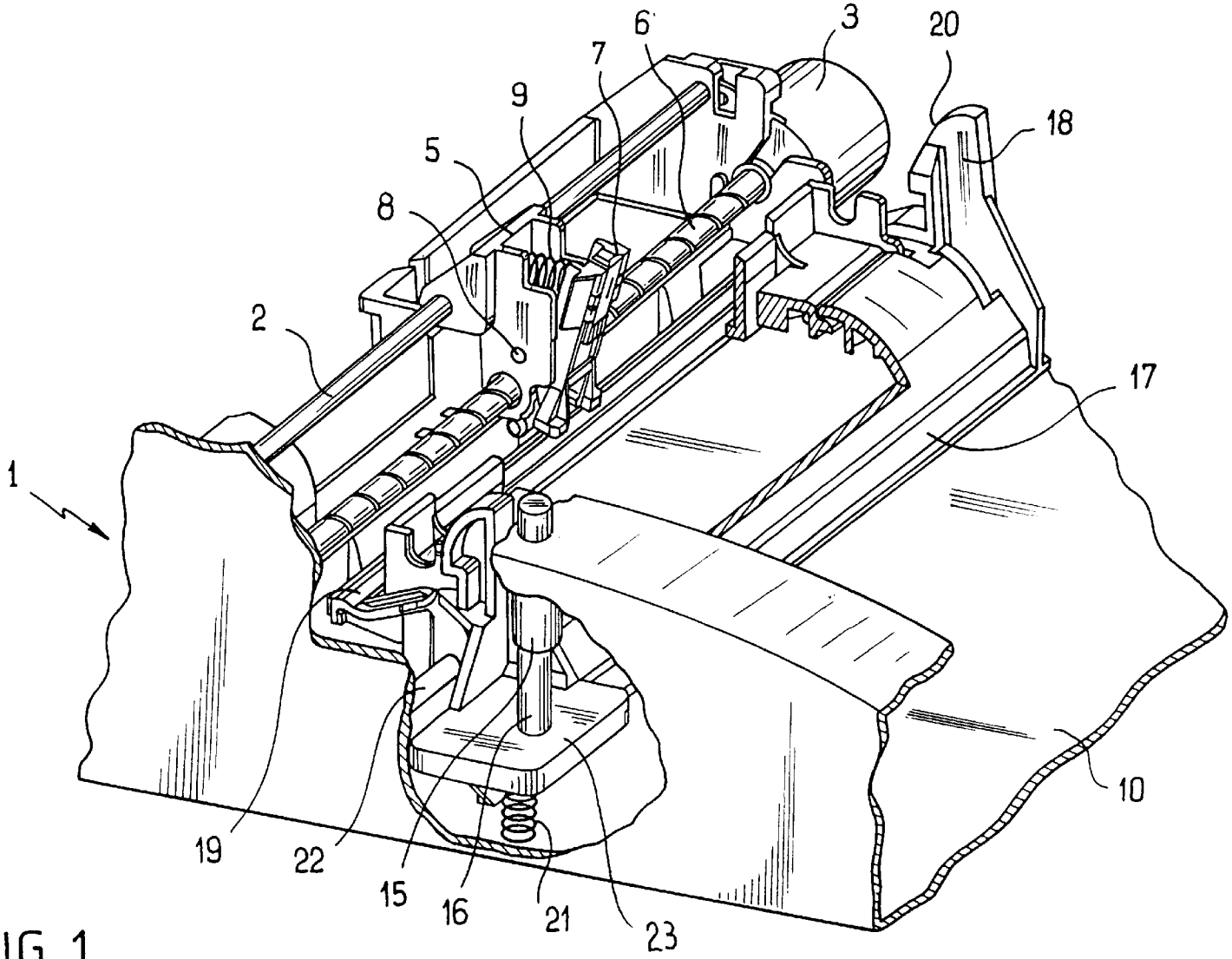
FIG. 1 is a simplified perspective view of the device of the invention.

The body shown in the figures in the form of a box 1 carries a guide-forming rod 2 along which there slides a carriage 5 constituting in conventional manner the nut of a screw-and-nut system whose screw 6 is parallel to the guide 2 and is coupled to a drive motor 3 secured to the box 1.

On a vertical flank parallel to its sliding direction, the carriage 5 carries a print head 7 that is pivotable about an axis 8 parallel to the guide 2 and secured to the carriage 5, and beneath the axis 8, between the carriage 5 and the head 7, the carriage also carries a spring 9 whose force tends to move the flank of the carriage 5 away from the top end of the head 7.

Figure 2:
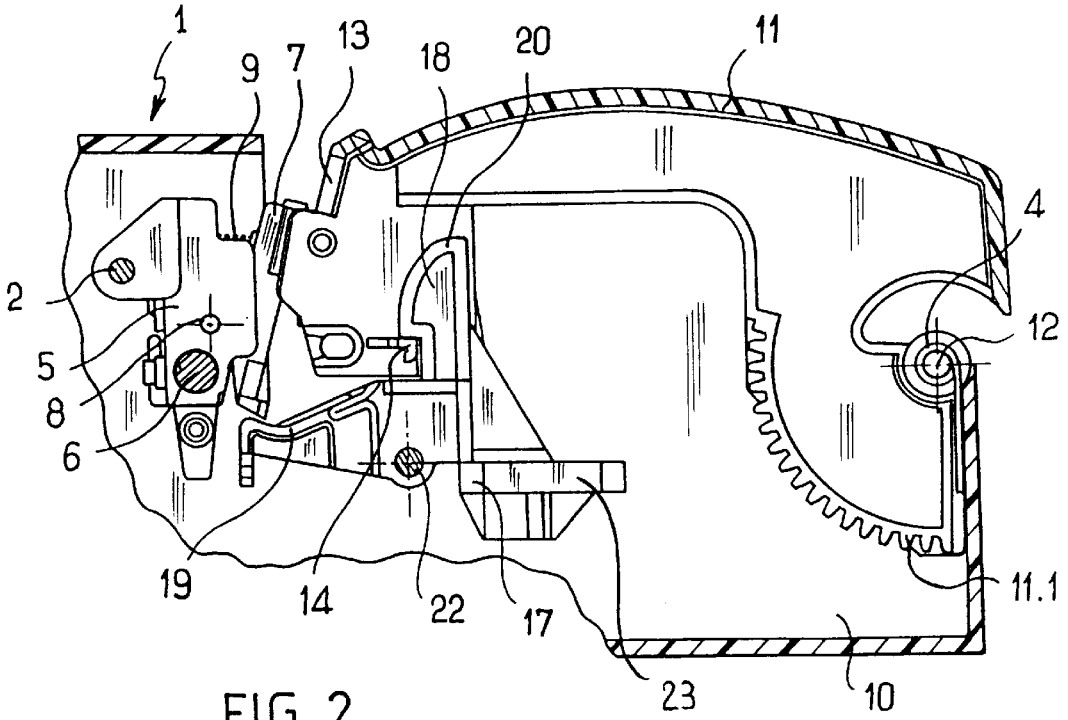
FIG. 2 is a simplified side view in partial section of the device of the invention in the closed position of the cover.
Figure 3:
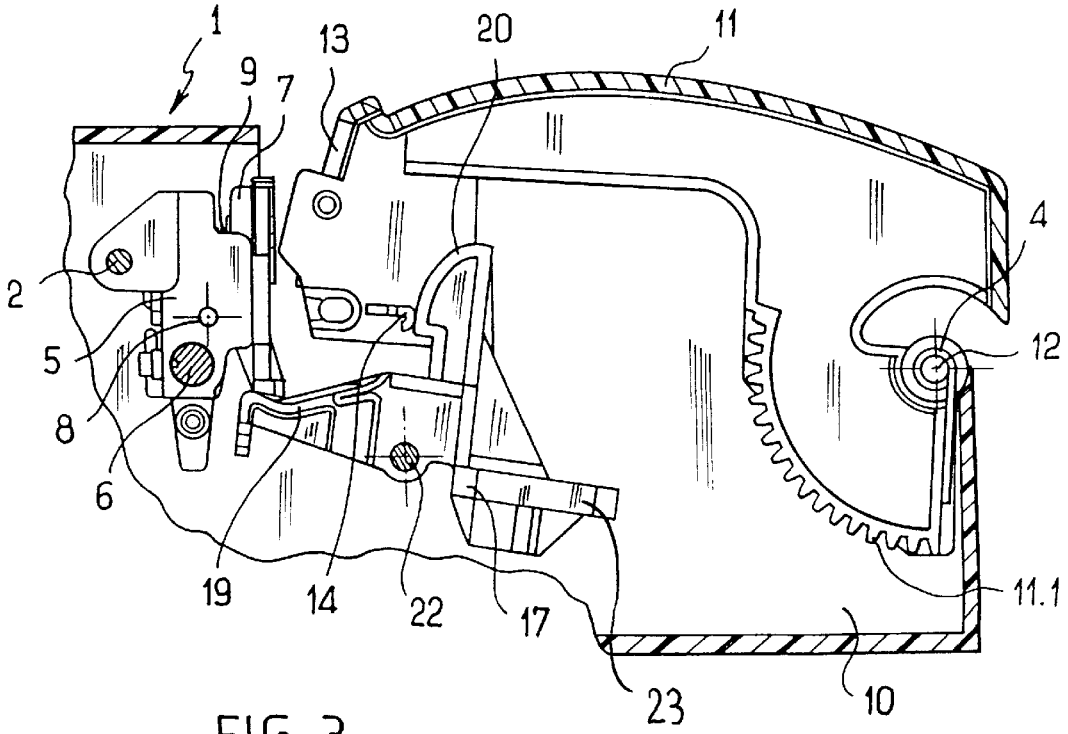
FIG. 3 is a simplified side view in-partial section of the device of the invention in an intermediate position between the closed and open positions of the cover.

The box 1 includes an opening that reveals a portion 10 that is closed by a cover 11 which is mounted to pivot between two positions about an axis 12 secured to the box 1 and extending parallel to the guide 2 along the side of the portion 10 remote from said guide 2. A hairpin spring 4 is placed around the axis 12 between the box 1 and the cover 11 so that the spring 4 tends to cause the cover 11 to pivot towards an open position in which it reveals the opening in the box 1. The cover 11 has two side walls (only one of which is shown in FIGS. 2 and 3) between which there extends a platen 13 providing a plane surface facing the head 7 and against which the head 7 bears resiliently under drive from the spring 9 when the cover 11 is in a closed position, as shown in FIG. 2. Via each of its side walls, the cover 11 carries respective abutments 14 disposed in register with each other and having respective rounded ends. A gear wheel (not shown) is pivotally mounted on the box 1 so that its teeth co-operate with the teeth of a portion of a toothed wheel 11.1 of the cover 11, and is coupled to a damper of a kind that is known per se and that tends to brake partly the action of the hairpin spring 4 so that the cover 11 opens slowly.

A locking member 17 is pivotally mounted about an axis 22 parallel to the guide 2 and secured via its ends to each of the two sides of the portion 10 that are perpendicular to the guide 2. The locking member 17 has two hooks 18 (only one of which is shown in FIGS. 2 and 3) disposed on either side of a lever 19 extending parallel to the guide 2 and having one end situated beneath the bottom end of the head 7. Each of the hooks 18 has an upper projection 20 of convex profile forming a surface for actuating the locking member 17. A spring 21 is disposed between the bottom of the portion 10 of the box 1 and a drive portion 23 of the locking member 17 extending behind the axis 22, i.e. on the side thereof that is remote from the lever 19.

From the figures, it will be observed that the locking member 17 pivots between two extreme positions. In a first position, the end of the lever 19 is to be found beneath the bottom end of the head 7. This position is reached, when, with the cover 11 being in its closed position, each of the hooks 18 retains a respective abutment 14 under drive from the spring 21, or when, with the cover being in its open position, the locking member 17 is bearing against the moving element 16 of a pushbutton 15 disposed on the box 1 vertically above the spring 21 (FIG. 1). In a second position, corresponding to an intermediate position of the cover 11 between its open and closed positions, the rounded ends of the abutments 14 secured to the cover 11 cause the lever 19 to pivot by bearing against the projections 20 of the hooks.18 against the force of the spring 21. The end of the lever 19 then pushes away the head 7 by acting on its bottom end against the force of the spring 9. In this position, the head 7 is no longer in contact with the platen 13.

In operation, when the cover 11 is in its closed position and the locking member 17 is in its first position, each of the hooks 18 retains a corresponding abutment 14, preventing the cover 11 from opening in spite of the force exerted by the hairpin spring 4. Acting on the button 15 causes its moving portion 16 to slide and one end thereof presses on the drive portion 23 of the locking member 17 against the force exerted by the spring 21 on said drive portion 23. The locking member 17 then tilts towards its second position. The hooks 18 of the locking member 17 then release the abutments 14 which come to press against the projections 20 and hold the locking member 17 in its second position even if contact between the button 15 and the drive portion 23 of the locking member 17 has ceased. In its second position, the locking member 17 presses via the lever 19 against the bottom end of the head 7, causing it to pivot against the force of the spring 9. The head 7 is then no longer in contact with the platen 13. Under drive from the hairpin spring 4 bearing against the cover 11, the cover continues to open while the locking member 17 returns progressively towards its first position under drive from the springs 21, because of the profile of the projections 20.

Once the cover 11 is open, an operator inserts a new roll of strip.

While the cover 11 is in its open position and the locking member 17 is in its first position but in contact with the moving element 16 of the button 15, the cover 11 can be closed progressively by the operator pressing against the force of the hairpin spring 4. The abutments 14 come into contact with the projections 20, causing the locking member 17 to pivot progressively towards its second position, thereby opposing the action of the spring 21. Via the lever 19, the locking member 17 then moves the head 7 away from the path followed by the platen 13 which is secured to the cover 11. At the end of the pivot stroke of the cover 11, the abutments 14 leave the projections 20 and are captured by the hooks 18 of the locking member 17 as it returns from its second position to its first position under drive exerted by the spring 21 on the drive portion 23. Return of the locking member to its first position causes the lever 19 to be lowered so its end no longer opposes the action of the spring 9 which again presses the head 7 against the platen 13.

Naturally the invention is not limited to the embodiment described and variants can be applied thereto without going beyond the ambit of the invention.

Figure 4:
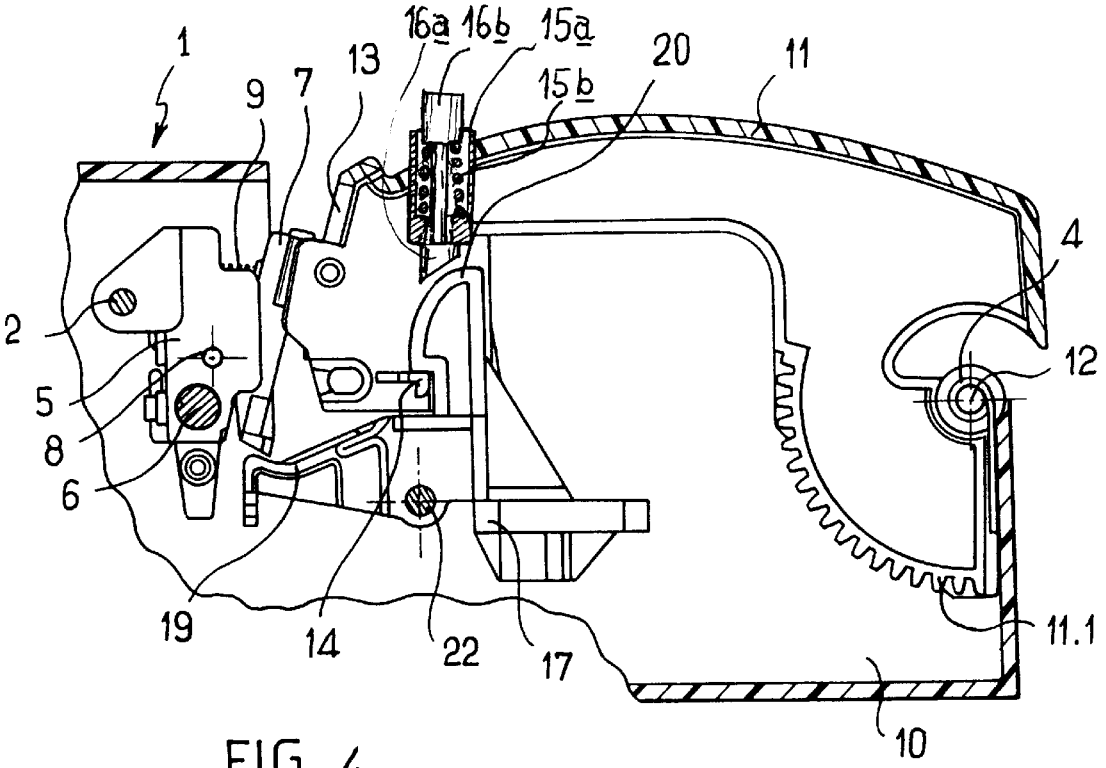
FIG. 4 is a view similar to FIG. 2 showing a variant embodiment of the invention in which the pushbutton is carried by the cover.

In particular, although the pushbutton is shown as acting directly on the locking member, it is possible to place the pushbutton so that a chamfered end of its moving portion acts on the projection 20 of one of the hooks 18. This variant is shown in FIG. 4. The pushbutton 15*a* is fixed to the cover 11, above the projection 20 of one of the hooks 18. The moving portion 16*a* of the pushbutton has a chamfered end 16*b*. The moving portion 16*a* is held at the top of the pushbutton by a spring 15*b* of stiffness that is less than the stiffness of the hairpin spring 4. In this way, when the moving portion 16*a* is depressed by the operator, the chamfered end 16*b* presses against the projection 20 and causes the locking member 17 to tilt, thereby releasing the abutments 14. The cover 11 then pivots slightly towards its open position under drive from the hairpin spring 4, thereby compressing the spring 15*b* between the body of the pushbutton which is secured to the cover and the moving portion 16*a* which is held down by the operator. The abutments 14 then press against the projections 20 and the operator can release-the moving portion 16*a* to allow the cover 11 to pivot fully.

In addition, although the locking member is shown as comprising hooks fitted with respective projections, another variant could consist in providing hooks that do not have projections. Under such circumstances, the operator must actuate the pushbutton 15 throughout the opening and closing periods, so as to ensure not only that the abutments are released, but also that the head is held in the disengaged position.

What is claimed is:

1. A printer device for printing on a strip medium, the device comprising a body (1), a carriage (5) movable in translation along a guide (2) secured to the body (1) and carrying a pivoting print head (7), and resilient means (9) disposed between the carriage (5) and the print head (7), a cover (11) carrying a platen (13) and pivotally connected to the body (1) to pivot between an open position and a closed position in which the print head (7) is held pressed against the platen (13) by the resilient means (9), a locking member (17) carried by the body (1) in retractable manner between a first position in which it co-operates with an abutment (14) secured to the cover (11) and a second position in which it escapes from said abutment, the printer device being characterized in that the locking member (17) is secured to a lever (19) hinged to the body (1), said lever (19) having an end that co-operates with the print head (7) in such a manner that during the movement of the locking member (17) between its first and second positions, the end of the lever (19) causes the print head (7) to pivot against the effect of the resilient means (9).

2. A printer device according to claim 1, characterized in that the end of the lever (19) is of a width that corresponds to the length of the displacement of the carriage (5).

3. A printer device according to claim 2, characterized in that the locking member (17) includes a camming surface (20) for moving it between its two positions, the camming surface co-operating with the abutment (14) by pressing thereagainst while the cover (11) is pivoting close to its closed position.

4. A printer device according to claim 3, characterized in that a pushbutton (15*a*) is carried by the cover (11) over the camming surface (20) when the cover (11) is in its closed position, action on the pushbutton causing the locking member (17) to be move from its first position towards its second position by sliding on the camming surface.

5. A printer device according to claim 4, characterized in that resilient return means are disposed between the body (1) and the locking member (17) to return the locking member (17) to its first position.

6. A printer device according to claim 3, characterized in that a pushbutton (15) is located on the body (1), operating the pushbutton (15) causing the locking member (17) to move from its first position towards its second position by acting on a drive portion (23) of said member.

7. A printer device according to claim 6, characterized in that resilient return means are disposed between the body (1) and the locking member (17) to return the locking member (17) to its first position.

8. A printer device according to claim 3, characterized in that resilient return means are disposed between the body (1) and the locking member (17) to return the locking member (17) to its first position.

9. A printer device according to claim 2, characterized in that resilient return means are disposed between the body (1) and the locking member (17) to return the locking member (17) to its first position.

10. A printer device according to claim 1, characterized in that the locking member (17) includes a camming surface (20) for moving it between its two positions, the camming surface co-operating with the abutment (14) by pressing thereagainst while the cover (11) is pivoting close to its closed position.

11. A printer device according to claim 1, characterized in that resilient return means are disposed between the body (1) and the locking member (17) to return the locking member (17) to its first position.

* * * * *